United States Patent [19]

Herrmann et al.

[11] Patent Number: 4,606,154

[45] Date of Patent: Aug. 19, 1986

[54] FLEXIBLE AND EXTENSIBLE COATED ABRASIVE MATERIAL

[75] Inventors: Lotte Herrmann, Schlatt; Jakob Ackermann, Wigoltingen; Armin Steiner, Wiesendangen, all of Switzerland

[73] Assignee: SIA Schweizer Schmirgel- und Schleif-Industrie AG, Switzerland

[21] Appl. No.: 553,135

[22] Filed: Nov. 18, 1983

[30] Foreign Application Priority Data

Nov. 22, 1982 [CH] Switzerland ..... 6768/82

[51] Int. Cl.[4] ..... B24D 11/00

[52] U.S. Cl. ..... 51/401; 51/297; 51/394

[58] Field of Search ..... 51/394, 400, 401, 404, 51/407, 297, 298, 358, 363, 372, 373, 374, 375

[56] References Cited

U.S. PATENT DOCUMENTS 3,136,614 6/1964 Kuzmick ..... 51/297
3,306,718 2/1967 Chapin ..... 51/297
3,787,273 1/1974 Okrepkie et al. ..... 51/407 X
4,055,897 11/1977 Brix ..... 51/401 X
4,225,321 9/1980 Swiatek ..... 51/297 X

FOREIGN PATENT DOCUMENTS 2632012 2/1977 Fed. Rep. of Germany ..... 51/401
2805288 8/1979 Fed. Rep. of Germany ..... 51/401

*Primary Examiner*—Robert P. Olszewski
*Attorney, Agent, or Firm*—Lyon & Lyon

[57] ABSTRACT

A coated abrasive material comprising a textile backing—in the form of fabric, webbing, fleece and/or laminated material, base binder, abrasive particles and optionally size coat which is characterized in that the textile backing is extensible and that on the particle side an elastic intermediate layer is applied which lies between the textile backing and the usual base binder. This intermediate layer may contain caoutchouc latex and/or polyurethane and/or polymers, which contain butadiene and/or acrylic acid ester. The flexible and extensible coated abrasive may be used for profile grinding, sanding or polishing.

8 Claims, 3 Drawing Figures

Load / Extension - Diagram

FLEXIBLE AND EXTENSIBLE COATED ABRASIVE MATERIAL

BACKGROUND OF THE INVENTION

1. Field of the Invention

The invention relates to an abrasive material, to a method for its manufacture and to the use of this abrasive.

2. Description of the Prior Art

The abrasion of profiles is frequently carried out with endless abrasive belts which must be guided via an abrasive contact wheel, a drive roll, if necessary a reversal roll and a tension roll, etc.

In order that the abrasive belt can be adapted to the contours of the workpiece to be processed, it is pressed from the rear side against the workpiece to be abraided by means of a rigid profiled abrasion shoe or abrasion block. A further possibility consists in that the workpiece is abraided by means of the abrasion contact wheel, the latter also being provided with the counterprofile of the workpiece to be processed.

Other devices for the abrasion of profiles using coated abrasives consist of profiled abrasion blocks, abrasion shoes, abrasion contact wheels or abrasion wheels which are overlaid by means of a flexible coated abrasive, for example using glueing or welding. In order to ensure adaption of the abrasive to the profile, it was previously necessary mostly to use expensive methods such as for example the cutting or provision of upset grooves.

In each case the requirement exists that the flexible abrasive is adapted exactly to the contours of the given profile.

In German Offenlegungsschrift No. 30 36 991 a device is mentioned for abrasion, particularly for surface abrasion of wooden parts, which consists in that an abrasive body is used which consists of an elastic raw material and which is surrounded at least partially by an endless abrasive belt which is elastic. Preferably the belt joint region of the abrasive belt is formed elastically.

In European Patent Application No. 0 052 866 A3, an abrasive belt for profile polishing is described which consists of an extensible fabric backing coated with abrasive particles, the warp threads of which backing running at a sharp angle of 20° to 60° to the belt direction and the abrasive belt having longitudinal zones of low extensibility.

It is true that some earlier known flexible coated abrasives had a certain degree of extensibility. This extensibility was however insufficient to satisfy the requirements which for example are made upon an abrasive for profile grinding. Even the abrasive on the fabric backing in which the extensibility was increased according to EP No. 0 052 866 A3, proves to be insufficient with difficult profiles. With the use of such an extensible abrasive, the breaking off of the abrasive particles is also very problematical as soon as it is stretched or extended more than a certain extent; such a degree of stretching is often required in profile polishing.

In the already mentioned German Offenlegungsschrift No. 30 36 991 it is explained that the manufacture of an elastic abrasive band (with the previously known abrasive) would not be possible owing to the disturbance of the surface during extension and the resulting breaking off of the abrasive particles.

SUMMARY OF THE INVENTION

An object of the invention is to provide an abrasive device which allows good adaption to the workpiece during abrasion, in particular during profile abrasion. A further object is to provide an abrasive device which can be used for the manufacture of profiled abrasive shoes, profiled abrasive blocks and profiled abrasive contact drums or abrasive wheels.

A flexible and extensible abrasive on a substrate which does not show the disruption of the layer and breaking off of the abrasive particles has surprisingly been found by manufacturing the abrasive on an extensible substrate preferably of textile material which is provided with an elastic (stretchable) intermediate layer which lies between the substrate and a base binder on which the abrasive particles and optionally covering binder are provided.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION AND PREFERRED EMBODIMENTS

Figure 1:
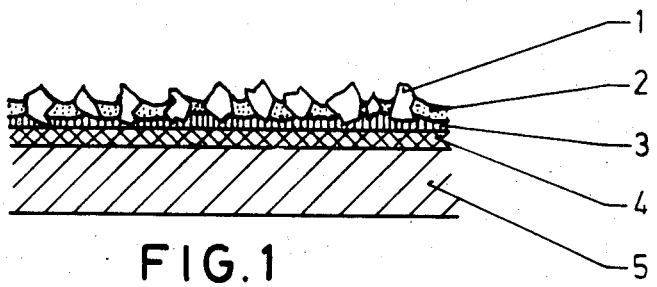
FIG. 1 shows a schematic cross-sectional view through one embodiment of abrasive device according to the invention.

FIG. 1 schematically illustrates the coated abrasive material including abrasive particles 1, a flexible and extensible textile backing 5, an elastic intermediate layer 4, a base binder 3 and a size coat 2.

The elastic intermediate layer 4 may comprise polyurethane, polyacrylate, caoutchouc latex and/or polymers containing butadiene, such as acrylnitrile-butadiene-styrene polymers or butadiene-styrene-polymers (cf. butadiene-polymers in "Kunststofflexikon" (Synthetics Dictionary 7th edition at pages 99 and 100, published by K. Stockhert, Carl Hanser Verlag 1981).

If necessary, these polymers can be modified by the addition of curing agents or cross-linking agents or as the case may be of curable resins or cross-linkable resins, such as phenolic resins, melamine resins, resorcin resins, or urea formaldehyde resins, in order to achieve the necessary elasticity and adhesion properties within a wide temperature range. Also, the elastic intermediate layer 4 may contain inorganic and/or organic filler materials.

It was found that the intermediate layer 4 has, to a greater or lesser extent, a pronounced elasticity (in the sense of the description in the Kunstofflexikon, ibid. page 151) or in other words a relatively low modulus of elasticity (according to DIN 53 475) and also ensures good adhesion to the textile backing 5 on the one hand and the base binder 3 on the other hand. The modulus of elasticity measured on a test body according to DIN 53 457 of the intermediate layer 4 should be no higher than 300 $N/mm^2$, preferably however no higher than 50 $N/mm^2$. The intermediate layer 4 can be applied on the textile substrate 5 by means of known methods, for example as a solution in an organic solvent, as an aqueous dispersion, or as a melt and if necessary can be chemically cross-linked. It is also possible to apply corresponding monomer or prepolymer substances to the substrate 5 and to carry out afterwards the polymerization and if necessary the cross-linking, for example by means of electron bombardment.

The thickness or amount per unit area of the intermediate layer 4 is not critical but depends to a certain extent upon the desired degree of extensibility and the nature of the textile substrate 5 i.e. the penetration depth into the substrate. In general, the desired results can be achieved with amount (dry) between 40 and 120 g/m$^2$.

In accordance with one embodiment of the invention , a textile surface construction is used as substrate 5 extensible in the longitudinal and/or transverse direction having fibers for example of cellulose, cellulose acetate, polyamide, polyester, polyurethane and/or caoutchouc polymers in the form for example of fabric, webbing, fleece, laminated material, layered material or mixed fabrics or mixed webbing which may be attached antistatically or with other fastening means. It is also possible to use an extensible, non-textile surface construction such as an elastic film material. Such substrates have however proved to be less suitable. The textile substrate 5 on which (on one or both sides) the elastic intermediate layer 4 is carried, can contain greater or lesser proportions of elastomers, thanelast fibers (elasthan fibers), elastic fibers, elastodiene fiber or threads (cf. Kunststofflexikon, 7th edition, ibid. pages 150–153).

Also highly elastic fibers which are extremely highly deformable and which have an elongation at break of more than 200%, usually 500 to 800%, may also be included in the textile substrate 5 before the base binder, abrasive particles and size coat are applied.

In the textile surface structure preferably used as backing 5 for the abrasive material in the form of a fabric, webbing, fleece, etc. there may be used weft fibers and/or warp fibers or yarns of higher elasticity or extensibility. Weft or warp fibers or yarns of higher elasticity can be manufactured using known methods, for example by entwining cotton fibers around a "core" of elastomeric fibers or by using textured or crinkly fibers or yarns.

As the base binder and size coat(s), the usual resin types such as for example phenol formaldehyde resins, urea formaldehyde resins or melamine formaldehyde resins are used. Preferably, phenol formaldehyde resins are used. Also the usual abrasive particles with the usual particle size are used for example aluminum oxide (corundum), zirconia alumina, silicon carbide, diamond, garnet, flint, emery.

In order that a flexible coated abrasive can adapt for example true to form to a profiled abrasion shoe, a profiled abrasion block, a profiled abrasion roll or an abrasion contact wheel, it must first have the necessary extensibility adapted to the given profile form, i.e. the coated abrasive must be capable of being stretched with comparatively low force and without breaking off of abrasive particles around sharply cambered parts or around parts which are sharply radiused. An extension of 40% or more of the original length of the abrasive sheet corresponds to a typical requirement.

Figure 2:
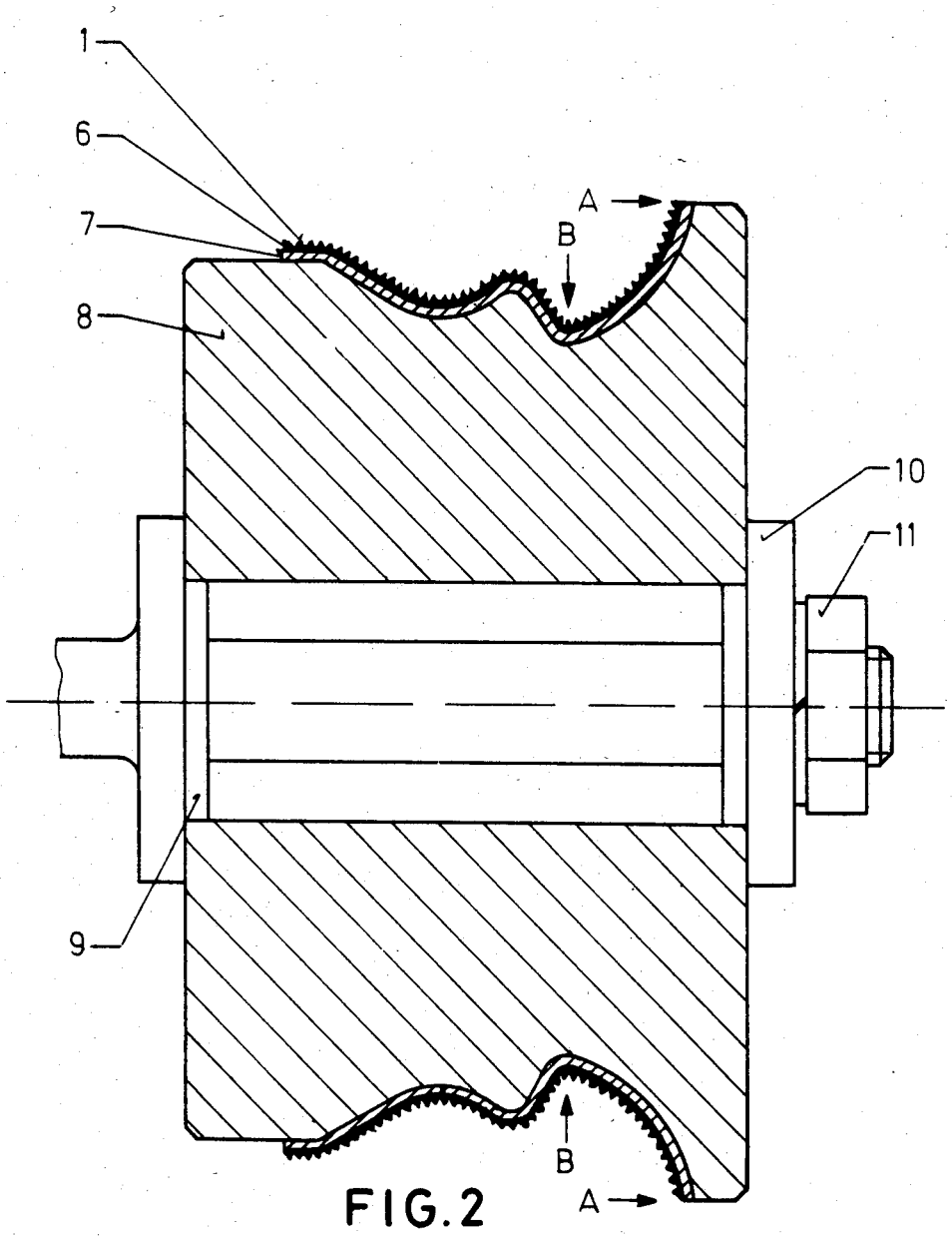
FIG. 2 shows an abrasive device secured to a profiled contact wheel.

The abrasive device according to the invention is suitable in particular for profile polishing or as the case may be for the manufacture of profile abraiding elements such as profile abraiding shoes profile abraiding blocks or profile abraiding contact rollers or wheels. The said profile abraiding elements can be manufactured in an economical manner by using the abrasive device according to the invention. The high extensibility enables adaption even to difficult profiles, so that the formerly used methods, such as cutting apart, the provision of thrust grooves, the use of segments having elastic connecting strips and others, are thus rendered unnecessary. FIG. 2 shows for example a cross-section of a profiled abrasive contact wheel manufactured from the flexible and elastic abrasive according to the invention. Reference numeral 8 shows the actual profile body which is covered by an abrasive device 6 according to the invention. Reference numeral 1 represents the abrasive particles and 7 represents the substrate of the abrasive. The periphery of the zone with the largest radius of the profile (A) is approximately 40% larger than that in the zone with the smallest radius (B). The profile contact wheel is secured on a mounting and drive device 9 by means of parts 10 and screw 11. The manufacture of the profile contact wheel body 6 and 8 can take place in various manners. The profile body 8 can either be manufactured separately, for example from wood or plastics according to known methods and thereafter the abrasive 6 be provided for example by glueing, or however the abrasive body 8 can be manufactured simultaneously with the covering abrasive 6 for example by means of injection molding methods from polyurethane resin foam. Such a wheel may be used for grinding or polishing difficult profiles.

Figure 3:
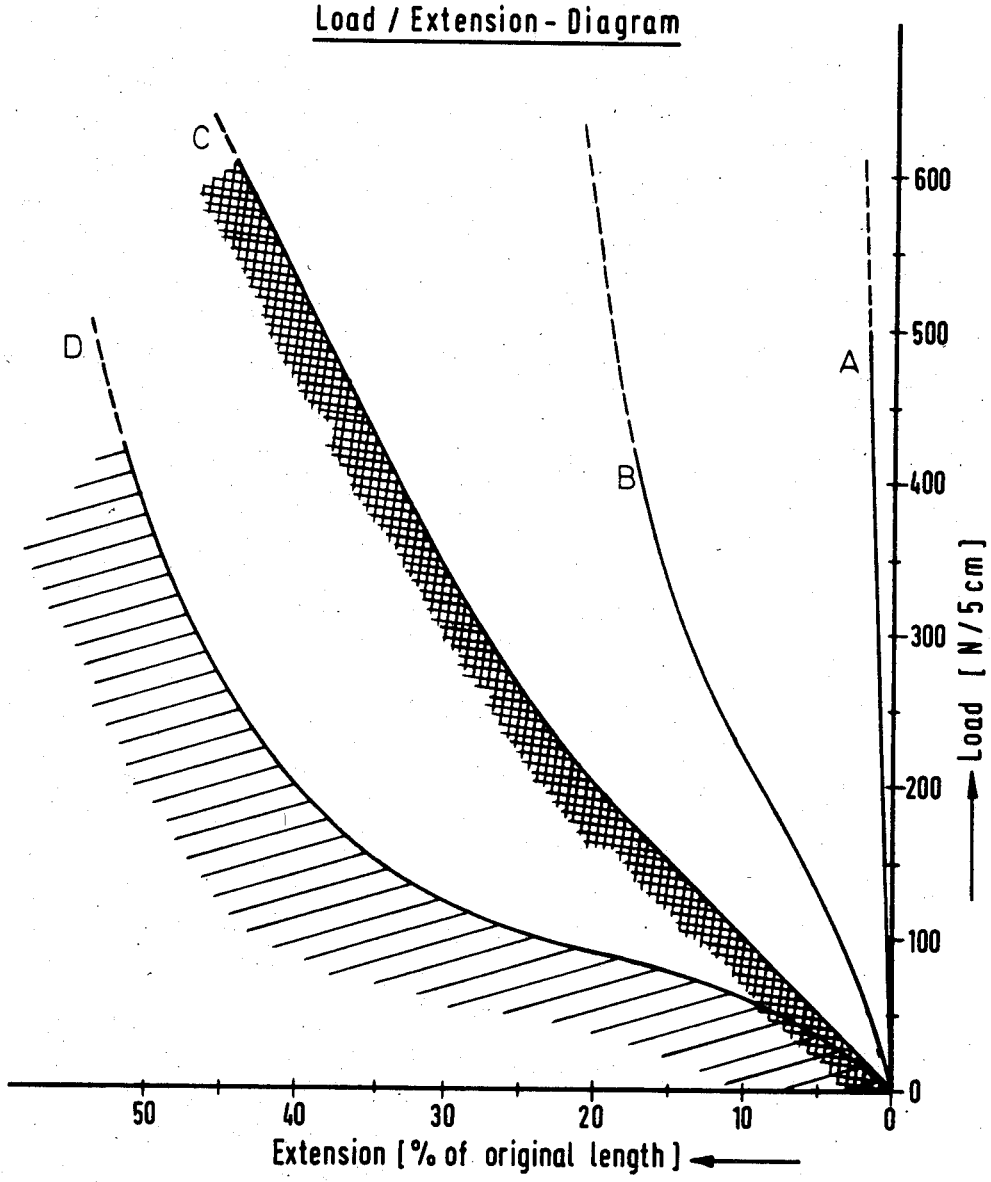
FIG. 3 is a load-extension diagram.

The extensible textile surface structure 5 can be arranged to be extensible in all directions or only in one direction. Preferably it is so constructed that extensibility is achieved especially transversely of the machine direction or longitudinal direction (with a webbing this corresponds in general to the weft direction). The abrasive device according to the invention preferably has in the longitudinal and/or transverse direction an extensibility of at least 10% under a load of 100 N/5 cm, most preferably however such an extensibility of at least 25% with the same load. The extensibility can be represented by the force-extension diagram of FIG. 3 where the extension or elongation of the abrasive is represented as a function of the load. On the one axis the load is represented in terms of N/5 cm wide strips and on the other axis the extension is represented in terms of % of the original length. In the diagram are represented four force-extension lines or curves, that is to say the curve A, B, C and D. The curves A and B serve for comparison and correspond to typical values of a usual abrasive on a substrate. Curve A corresponds to the machine or longitudinal direction, and curve B to the transverse or weft direction of a typical usual flexible abrasive on a webbing substrate (abrasive having the trademard designation "SIATUR JJ" of the firm SIA). The lines C and D correspond to the abrasive device according to the invention, and represent boundary lines. The curves of the abrasive device according to the invention lie in the field left (double hatched area) of the boundary line C or preferably in the field left (single hatched area) of the boundary line D. The breaking load is not represented in the diagram.

The following examples illustrates the invention:

EXAMPLE 1

A fleece of polyamide fibers having a weight of 135 g/m$^2$ and having a breaking extension in the longitudinal direction of 65% and in the transverse direction of 90% was coated with a dispersion of a co-polymer on the basis of butadiene and styrene (50% solids content).

The dispersion was applied by means of a doctor blade in an amount of 120 g/m$^2$ (wet) and finally dried for 2 minutes at 120° C. in a surface dryer. This polyamide fleece provided with the elastic intermediate layer was then used as backing material for a flexible coated abrasive. As base binder for the abrasive particles, an aqueous phenol formaldehyde resol filled with 20% limestone powder was used; the solid body content amounted to 62% by weight. The phenolic resin was applied to the coated side of the polyamide fleece in an amount of 70 g/m$^2$ by means of roll coating. To this layer, 160 g/m$^2$ of commercially available aluminium oxide abrasive particles (particle size no. P 120) were applied. The application process was carried out according to the electrostatic coating method common in the abrasive industry. Next, the coated fleece was hung up and the base binder was dried and cured for 15 minutes at 80° C., 15 minutes at 95° C. and 20 minutes at 120° C. A size coat was then applied by a rubber roll in an amount of 260 g/m$^2$. The size coat consisted of the same phenol formaldehyde resol as the base binder but the proportion of filler amounted to 50%. The size coat was dried and cured in a festoon dryer. The finally cured abrasive was flexed so that the hard phenolic resin—abrasive particle—coating was broken into small segments. Examination of the finished abrasive material showed that the high extensibility measured on the fleece was also present in the abrasive. Thus, for example, the extension transversaly amounted to 40% at a load of 100 N/5 cm. The adhesion of the abrasive layer was very good and corresponds to a conventional abrasive with smaller extensibility. The abrasive material can be adapted in a true manner to contours on a profile abrasion block, this being extended in some zones up to 40% of its original length.

EXAMPLE 2

As backing, a fabric with elastic weft and a weight of 150 g/m$^2$ was used for the manufacture of a flexible and elastic abrasive material. The backing was a cotton fabric in a linen weave whose weft fibers were manufactured by spinning cotton around a "Lycra" ® fiber core ("Lycra" is a registered trademark for the elastic polyurethane fibre of DuPont de Nemours, also known as "Spandex"). The ratio of cotton to "Lycra" amounted to 90:10 (by weight). This fabric was coated with a doctor blade with 120 g/m$^2$ of a dispersion of thermically cross-linkable co-polymers on a base of acrylic acid ester (50% by weight). The layer was dried in a flat dryer for two minutes at 130° C. The application of the abrasive layer was the same as in Example 1; however an abrasive particle size no. P 80 was used. Examination showed that the high extensibility of the initial web was still present in the final abrasive material. The extensibility value amounted to 30% at a load of 100 N/5 cm and to 45% at a load of 200 N/5 cm. The adhesion of the abrasive particles proved to be very good also after the extension and the manufacture of a profile abrasion contact wheel according to FIG. 2.

EXAMPLE 3

A fabric having highly elastic textured polyester filament yarn weft and cotton warp in twill weave and having a weight of 200 g/m$^2$ was coated with a polyacrylic ester dispersion. This dispersion (40% by weight) was applied with a doctor blade to an amount of 80 g/m$^2$ this case the construction of the abrasive coating was the same as in Example 1. The extensibility transversely of the finished abrasive was hardly any different from that of the raw web. The extension at a load of 80 N/5 cm in the weft direction amounted to 24% and the particle adhesion was completely satisfactory.

What is claimed is:

1. A coated abrasive material which is flexible and extensible, having an extensibility at least in one direction of at least 10% at an applied load of about 100 N/5 cm (=11.3 lb/inch) comprising a flexible and extensible textile backing material; an intermediate layer applied on at least a grain side of said backing material, said layer containing at least one elastic polymer and having a modulus of elasticity of not greater than about 300 N/mm$^2$; a base binder means on said intermediate layer; and abrasive particles in said base binder means.

2. A material according to claim 1 wherein at least one size coat is applied to said particles.

3. A material according to claim 1 wherein said extensibility is longitudinal and amounts to at least 25% at an applied load of about 100 N/5 cm.

4. A material according to claim 1 wherein said modulus is not greater than about 50 N/mm$^2$.

5. A material according to claim 1 wherein the textile backing material is selected from the group consisting of thanelast fibers; thanelast threads; elastodiene fibers; and elastic fibers.

6. A material according to claim 1 wherein the textile backing material is selected from the group consisting of a fabric, web, fleece and a laminated material.

7. A material according to claim 1 wherein said extensibility is transverse and amounts to at least 25% at an applied load of about 100 N/5 cm.

8. Method for manufacture of a coated abrasive material which is flexible and extensible, having an extensibility (elongation) at least in one direction of at least 10% at an applied load of about 100 N/5 cm (=11.3 lb/inch) in which a flexible and extensible textile substrate is coated on at least a grain side of said substrate with an elastic intermediate layer, said layer containing at least one elastic polymer and after its hardening having a modulus of elasticity of not greater than about 300 N/mm$^2$, and a base binder means and abrasive particles are applied on said intermediate layer.

* * * * *